United States Patent [19]

Brown et al.

[11] 4,373,723

[45] Feb. 15, 1983

[54] AMUSEMENT APPARATUS

[76] Inventors: George E. R. Brown, 42 Rimington Way, Osgodby, Scarborough, North Yorkshire, England, YO11 3QN; Arthur E. Helm, 32 Beresford Dr., Churchtown, Southport, Merseyside; Stuart Keane, Dove Cottage, 15, Garden La., Sherburn in Elmet, Yorks, both of England

[21] Appl. No.: 189,968

[22] Filed: Sep. 19, 1980

[30] Foreign Application Priority Data

Sep. 22, 1979 [GB] United Kingdom ..... 7932929

[51] Int. Cl.[3] ..... A63F 9/14

[52] U.S. Cl. ..... 273/86 B; 273/85 G; 273/138 A

[58] Field of Search ..... 273/86 B, 138 A, 856

[56] References Cited

U.S. PATENT DOCUMENTS 3,729,193 4/1973 Labis ..... 273/138 A 3,770,269 11/1973 Elder ..... 273/138 A 4,090,713 5/1978 De Cesare ..... 273/86 B

*Primary Examiner*—Vance Y. Hum

*Assistant Examiner*—Leo P. Picard

*Attorney, Agent, or Firm*—William A. Drucker

[57] ABSTRACT

Amusement equipment relies on horses or other objects to traverse a course (tracks each 10, 11, 12) for each game and produce a winner. An electronic control unit (ECV) provides intermittent drive signals for such course traversal so that control over a first part of the course is by means (20) producing unpredictability, and control over a final part of the course is by means (21) that preselects the winner also on an unpredictable basis. Individual probabilities of winning can be imposed by stored information (28), particularly where payouts are made of corresponding odds via player stations (110) at desired positions. The player stations will receive control information via a data transmitter (115) and connection system (116).

23 Claims, 8 Drawing Figures

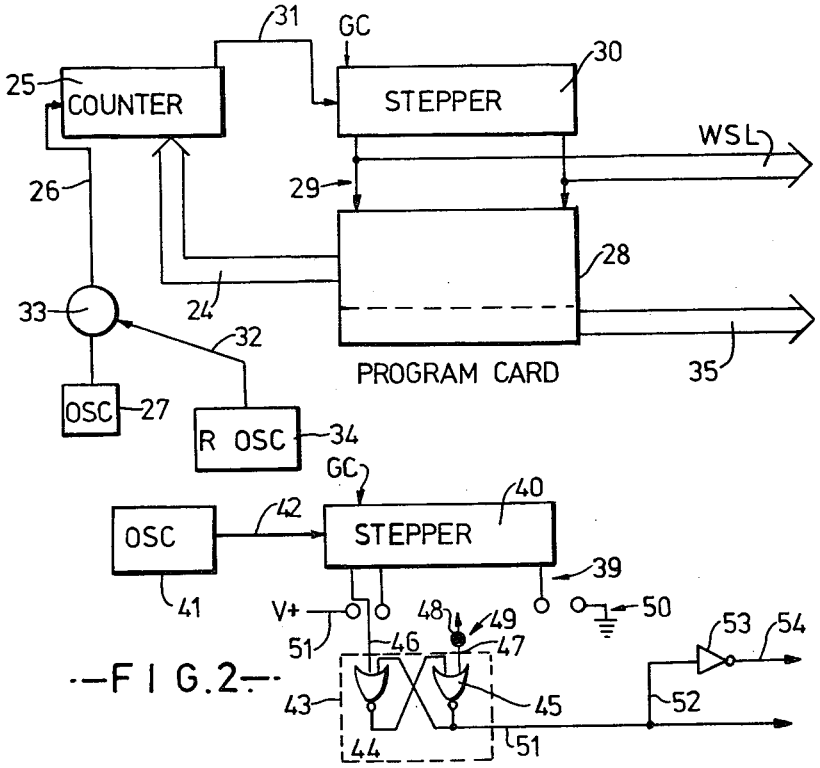
FIG. 2
FIG. 3
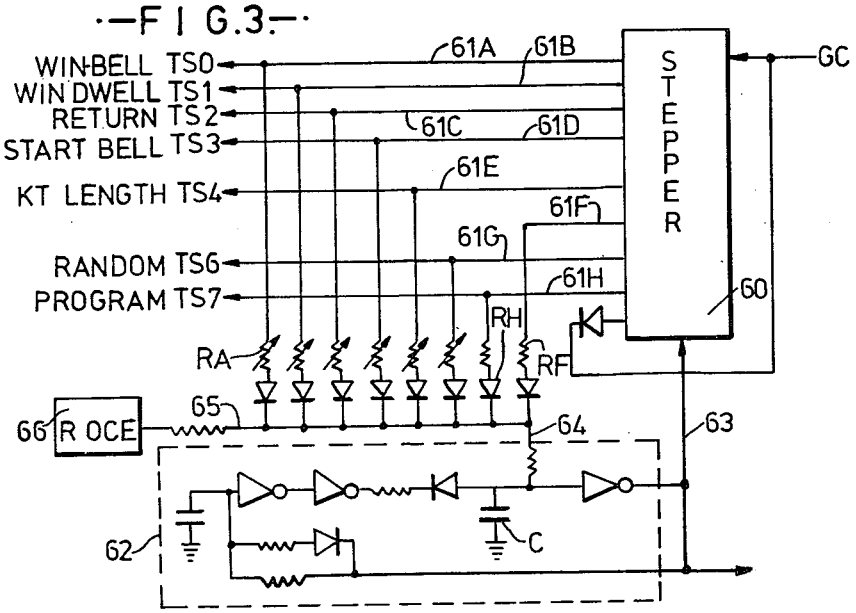

AMUSEMENT APPARATUS

DESCRIPTION

The invention relates to amusement equipment.

Multiple-player amusement games are known where each individual player's efforts result in the movement of a player-related object and the winning player is the first to achieve a given distance of such movement, or the one who achieves the greatest such movement in a given time. We ourselves, make a horse-race amusement game of this general type where a plurality of horses "run" on a bank of parallel tracks by movement increments determined by which, if any, of scoring holes in his playtable a player manages to roll his ball, and the value of that scoring hole. Our drive system uses tracks with selective drive over the required length or lengths of each unit increment of each player's relevant "score" and the horses are animated in their movement over the tracks. This game has been found not only to have high player appeal but also to attract spectators who will watch the horses and show great interest in which one wins.

It is an object of this invention to provide amusement equipment that, for the most part, exploits this spectator interest.

According to one aspect of this invention, therefore, we propose apparatus for causing and controlling the movement of a plurality of objects over a course, usually a set of parallel tracks, the apparatus including means for selecting which object shall win, i.e. complete the course first or move furthest, means for moving the objects irregularly over at least a first part of the course, and means for ensuring that the selected object is first to complete traversal of a final part of the course. The objects could even be lights.

Naturally, the preferred embodiment of the invention will include a set of animated horses driven along tracks, preferably in a sloped bank with parallel tracks one higher than the other in sequence. For convenience, then, we shall henceforth herein refer to horses and tracks therefor but, wherever the context permits, such terms shall be taken to apply to any object and any path, for example racing dogs, cars, monkeys up poles, or any other desired or possible arrangement.

The irregular drive over the first part of the tracks, which could of course be very much the majority of the course, should be unpredictable or at least difficult to predict by a watcher. A random or pseudorandom basis would suffice, especially on a stop-start, increment-type basis. Also, of course, the final drive of the winning horse should preferably be unpredictable as between the horses on successive runs. Advantage may also be gained if the onset of that final drive is from different track positions as will normally be the case for unpredictable drive prior to that time.

Clearly, spectator interest would be much enhanced by a system of betting on the outcome of particular races or runs. That could be done on a normal bookmaking or totalisator basis where each race was treated separately and odds offered on the particular horses determined only by relative total bets thereon and the operator's profit margin.

It is, however, our belief that there is greater appeal to the punter if the horses each have fixed odds against them and are, in fact, subject to relative control to comply with those fixed odds.

Thus, another feature or aspect of this invention comprises the provision of means that imposes long term weightings on the winning chances of particular horses, preferably without a discernable race-to-race pattern. This is conveniently done by imposition on the selection means.

One convenient way of setting the horses' form to match a desired set of odds is to arrange that win selection lines, one per horse, are each energised in any given one of successive time periods for intervals that are related to each other in inverse correspondence to the fixed odds, i.e. the shorter the odds the longer the energisation, and for that line energisation to become staticised during the race whereupon the selected horse can be continuously driven to the finish. That is particularly effective visually where preceding horse drive has been on a stop-start basis.

It is especially preferred herein that the endmost part of horse movement is entirely under the control of the weighting circuitry. That ensures that, whatever the results of previous random drive, only the selected horse can win.

It is possible to randomise either the time of staticisation or to variably interrupt the sequences of energisation of the win selection lines. Furthermore, as a random or pseudo-random drive is applied to the horses on a stop-start basis, it is possible to utilise only the one random means, though that is not specifically described herein.

Commercial exploitation of a betting facility is, we believe, very conveniently and advantageously achieved via a further aspect of the invention wherein at least one, preferably two or more and perhaps as many as a hundred or more, player stations are linked to the horse running control unit, and each such player station permits coins or tokens to be inserted therein and credited as a bet on one or more selected horses.

Preferably, such a player station displays the bet or bets placed and is controlled by the control unit to pay out only for the bets, if any, on the winning horse.

One embodiment of player station permanently displays horse odds and has select buttons or switches for bet placement as well as showing actual amounts of the bets, say by a number of tokens or coins on a unit basis.

BRIEF DESCRIPTION OF THE DRAWINGS

FIG. 2 shows the logic circuit for weighing the probability of each horse winning.

FIG. 3 shows the timer.

Figure 1:
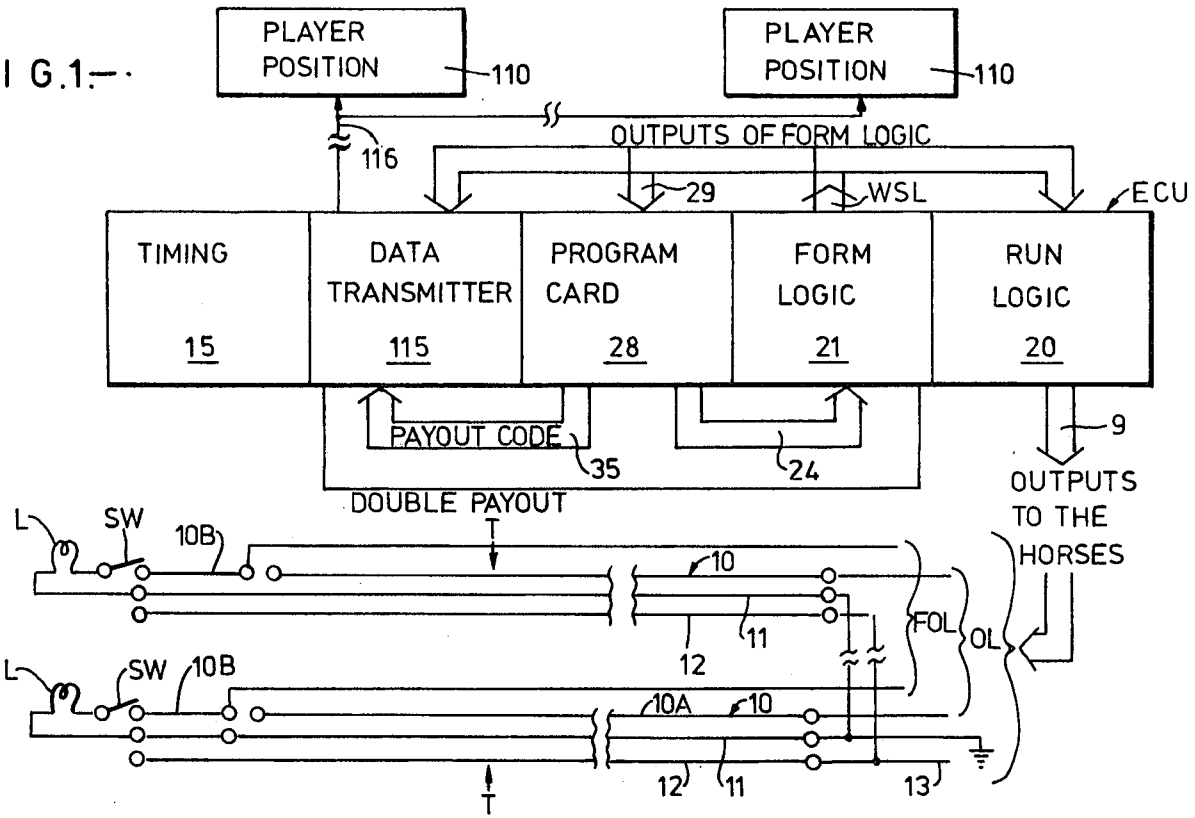
FIG. 1 is an overall view of the track and the control system.

Specific implementation of the invention will now be described, by way of example, with reference to the accompanying drawings, in which:

In FIG. 1, ten tracks T are shown controlled by an electronic control unit ECU over outlet lines 9 therefrom. It is preferred that each track T comprises three conductive rails 10, 11 and 12 so that a horse (not shown) on a wheeled trolley can be driven by a motor that picks up electrical power from the rails via wiping brush contacts. One rail 11 will be a common power ground rail, and the direction of horse travel depends on which of the the other rails 10 and 12 is energised, rail 12 being assumed to be a return drive rail.

Obviously, other drive mechanisms could be used, for example linear electric motors, or motor-driven pulleys and towing lines, or motor-driven belts, etc.

The forward drive tracks 10 are each shown as being in two parts, a first part 10A running most of the length of the track and a second section 10B that is much shorter, preferably one horse-length long. Parts 10A are fed by output lines OL. Further output lines FOL feed the final lengths of track 10B and the control unit ECU will, in practice, energise only one of these at any one time, as will be described, so that there can be only one winner of any race over the course represented by the tracks.

Analagous final track traversal arrangements could, of course, be made, say using switches to isolate the final track parts, or to prevent and permit final towing line or belt movement, etc.

Switches SW are shown at the end of each of the tracks T and are operated in any convenient manner by the horses so as to light lamps L that thus serve for indicating the winning horse. That switch SW may also send a signal back to the control unit ECU so that, after a short delay set by timer 15, power will be applied via 13 to track rails 12 to return all of the horses to the start ends of the tracks or course. However, in practice, it is often satisfactory simply to rely upon timer 15 setting a sequence of intervals as will be described later herein.

The control unit ECU, comprises two track energisation units 20 and 21 of which unit 20 serves for energising the tracks T over lines OL in a random or pseudo-random manner. Unit 21 effectively selects the winner of each race according to energisation of win selection lines WSL at a time set by timer 15, see FIG. 3.

The form logic 21, see FIG. 2, performs the basic function of weighting the probability of each horse winning. The timer 15 ensures that the incidence of wins for the horses is unpredictable. The weighting is shown to be achieved using a counter 25 that is decremented by clock pulses on line 26 from a stable oscillator 27. The counter 25 is reloaded over lines 24 at each zero value from a program card 28 such as a diode matrix having a number of multi-digit locations equal to the number of horses. The multi-digit locations of the program card 28 are enabled one at a time in sequence over lines 29 from a stepper circuit 30, such as a shift register containing a single binary "1" and driven by zero indicator output 31 of the counter 25.

The numbers stored in the multi-digit locations of the program card 28 will be inversely related to the desired odds for the horses, respectively. The following table may be found useful in considering one particular scheme.

TABLE

| HORSE | PROGRAM CARD NUMBERS | PROGRAM CARD ODDS | | |
|---|---|---|---|---|
| A | 200 | 2 | 400 | 40.0 |
| B | 200 | 2 | 400 | 40.0 |
| C | 133 | 3 | 399 | 39.9 |
| D | 133 | 3 | 399 | 39.9 |
| E | 100 | 4 | 400 | 40.0 |
| F | 67 | 6 | 402 | 40.2 |
| G | 57 | 7 | 399 | 39.9 |
| H | 50 | 8 | 400 | 40.0 |
| I | 40 | 10 | 400 | 40.0 |
| J | 20 | 20 | 400 | 40.0 |
| HORSE | WINS/1000 | ODDS | PAYOUT/ | % |

TABLE-continued

| HORSE | PROGRAM CARD NUMBERS | PROGRAM CARD ODDS | | |
|---|---|---|---|---|
| | | | 1000 | PAYOUT |

It will be noted that, so far as applicable, the top column designations concern apparatus functions or features and the bottom colunn designations concern betting features. Betting will be discussed in greater detail later.

The first column represents ten horses A-J, which may correspond to the tracks and horses, as desired. The second column represents numbers (in decimal) stored in the program card 28 in binary form, and the third column shows the desired odds which are expressed inclusive of a returned stake and are approximately 40% of the actual probabilities represented by the numbers in the second column over one thousand races. This is demonstrated by the fourth and fifth columns which show that a level unit stake on each horse over 1000 races can be expected to produce total returns as shown in the fourth column producing a percentage stake return shown in the fifth column.

Clearly, the program numbers and payout odds can be varied by replacement of one diode matrix card by another.

Clearly, the relative lengths of time for which any of the stepper outputs 29 and the win selection lines WSL are energised will be directly proportional to the numbers successively loaded over lines 24 from the program card 28 into the counter 25. Obviously, these will follow a set sequence over periods effectively set by the clock oscillator 27. Periodically, one for each game, at times set by a signal over line 32, the outputs of the win selection lines WSL are staticised. As shown, this is done using gate 33 as an inhibit for the output 26 from the oscillator 27. The time at which this staticisation of lines WSL occurs is required to be substantially random and without predictable sequence from race to race and that can be achieved using an erratic long-time-constant oscillator 34, typically a Schmitt-trigger type oscillator that is "noisy", i.e. is deliberately allowed to be sensitive to mains interference, any local power supply transients, etc. The effect will be as desired for frequencies of oscillators 27 and 34 (nominal) that differ by several orders of magnitude, for example a stable 5 to 10 KHz frequency for clock oscillator 27 and a nominal time constant of one-minute for the oscillator 34, actually varying in practice from 50 to 70 seconds.

In practice, as will be described, we prefer to provide the equivalent of oscillator 34 in the timer 15 as an advantageous additional element of unpredictable and varying timing of the various stages of each race is thereby obtained.

Before leaving FIG. 2, however, the provision of the odds or payout order code of the third column of the table is described. This could obviously be done using decoding circuitry fed by branches of the win selection lines WSL. However, it is more economical and just as reliable to do so by direct read-out of further digit positions of each word location in the program card 28 as indicated by lines 35 therefrom.

Also, player appeal of any chance game is enhanced, as is realised by manufacturers and operators of so-called "fruit machines", by provision for a doubled pay-out. That is used herein to adjust the overall actual pay-out percentage of the last column of the table upwards from the indicated 40% to as high as 80%. The circuitry for achieving this is also shown in FIG. 2 as comprising a stepper 40 with stage ourtputs 39 and driven by a "noisy" oscillator 41 over line 42. A bistable latching circuit 43, actually shown as two cross-coupled NOR gates 44, 45, has a first, reset or priming, input 46 connected to the first stage output of the stepper and a second or latching input 47 connected to wiper 48 of a selection switch 49 relative to a set of terminals 50. The first or left-most one of terminals 50 is permanently connected to positive potential at 51 and the last or right-most one is permanently connected to ground. The wiper 48 can be positioned on any one of the terminals 50 to give a variable mark-space ratio on output 51 of the bistable 43 in substantially equal increments between extreme continuous constant voltage conditions. The number of the terminals 50 determines the increments and a total of eleven thereof will give ten 4% payout increments as desired for variation between 40% and 80% payout. Output 51 is branched at 52 via an inverter 53 to give both single and double payout signals on lines 51 and 54 as binary "1"s and binary "0"s.

The fact that the clock oscillator 27 is stopped at a time in each race that is random as to staticisation of the win selection lines WSL, and that the oscillator 41 is erratic and unsynchronized with clock oscillator 27, means that the mark-space ratio of outputs 51, 54 will also be unpredictable and substantially random even using similar frequencies for the oscillators 27 and 41. In fact, of course, the oscillator 27 need not be stable itself, but that may be preferable to avoid inadvertent synchronization by spurious mains spikes. Also, of course, the outputs 51, 54 will also effectively be staticised at the same time as the win selection lines WSL, as will become clear in describing data transmission and actual doubling by shifting of the payout code data by one digit position.

It is convenient now to describe the timer 15, see FIG. 3. There, successive time intervals are set by charging and discharging of a capacitor C that itself controls traversal of a stepper circuit 60 whose outputs 61A to 61H provide time control pulses for the purposes specified on the drawing. The entire circuit 62 including capacitor C comprises a variable time period oscillator for providing clocking pulses on line 63 to the stepper 60. All connected in common to the same terminal 64 of the circuit 62, are branches from the stepper outputs 61 containing resistors RA to RH and output 65 of a low frequency noisy oscillator 66 actually serving, inter alia, the purpose of oscillator 34 of FIG. 2. The oscillator output 65 can produce, at maximum, only a proportion of the signal level required by the capacitor C, the remainder being provided via whichever one of the resistors RA to RH is actually energised by the corresponding stepper output 61. The resistors, or at least some of them are variable, so that adjustment of the lengths of time-slots TS0 to TS7 can be attained within desired limits.

The time-slot sequence will now be explained in detail. Thus, the sequence always starts at time-slot TS0 corresponding to energisation of a win bell which, in practice, will use a switch in series with a paralleling of the light switches SW of FIG. 1 and can only sound if a horse win switch SW is closed. The next time-slot TS1 allows a further period during which the appropriate horse lamp is alight, for players to check it, and is termined "win dwell". In time-slot ST2, the lines 13 of FIG. 1 are energised to return all of the horses along the full traversed lengths of their tracks. Time-slot TS3 then causes actuation of a start bell by closing an appropriate switch and warns players that a race is about to commence.

Thereafter, in time-slot TS4, all of the horses are advanced simultaneously by about one length, possibly on a separate initial track section, but otherwise dependent only on a set time. That is clearly optional but has been found to add significantly to player appeal. A further dwell time will then occur in time-slot TS5 and at least all of the time-slots to date can be adjusted and used to lengthen time available for placing bets.

Time-slots TS6 corresponds to random running, which will be next described, and time-slot TS7 to programmed running as will also become clear. The last output, or outputs if the stepper is longer for any reason (such as ease of purchase), will be used via line 68 to initialize the stepper 60 on its general clear and initialization input GC. Corresponding such inputs GC are also shown for the steppers 30 and 40 of FIG. 2 and are energized only on initial switch-on of the apparatus.

Figure 4:
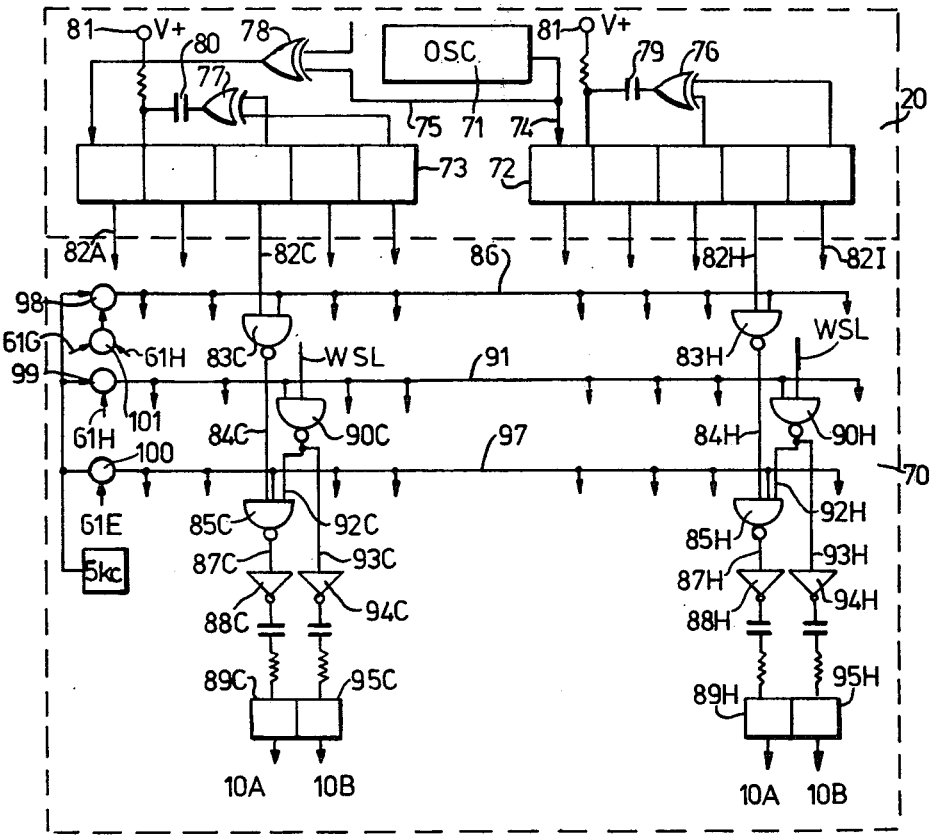
FIG. 4 shows the random run provision and the run drive circuitry.

Turning now to FIG. 4, that shows both the random run provision 20 and run drive control circuitry 70. In putting this invention into effect, randomizing of the appropriate part of the race is preferably done utilizing a quasi-random generator, such as a Johnson counter. As shown, a so-called maximally-long, twisted-tail shift register arrangement is driven by a clock 71 at suitable frequency, for example 1–2 Hz. Two five-stage shift registers 72 and 73 are shown, one for odd and the other for even numbered horses, and each driven over lines 74, 75 from the clock oscillator 71, which need not be stabilised. In practice, of course, two four-stage registers may be used each with an additional bistable circuit to give the other stage, thereby making best use of available integrated circuitry. For each shift register 72, 73, Exclusive-OR gates 76, 77 receive inputs from the third and fifth stages and supply the first stage. Also, a further Exclusive-OR gate 78 is shown in the line 75 and also fed with 5–10 KHz signals from elsewhere in the apparatus to "kick" the shift registers out of any developing sequence at least on start of each race. Capacitors 79,80 in the outputs of gates 76 and 77 serve to ensure that an all zero state cannot prevail, due to charging thereof over positive voltage terminals 81.

Outputs 82A to 82I correspond to the horses to be driven and will serve to effect random drive at the appropriate time-slot TS6 when line 83 will be energised to enable coincidence gates 83A to 83I whose outputs 84A to 84I serve, at random run time, to supply NAND gates 85A to 85I for the passage therethrough of track drive current, preferably alternating and available at a suitable frequency, say 5 KHz, on line 86. Outputs 87A to 87I from gates 85A to 85I are applied via driver amplifiers 89A to 89I, a.c. couplings, and triacs 89A to 89I to track sections 10A.

The further illustrated coincidence gates 91A to 91I serve for programmed run drive and receive the win selection lines WSL, respectively, as well as a further alternating current drive signal line 91. Outputs 92A to 92I of the gates 90A to 90I supply, over branches 93A to 93I, drivers 94A to 94I and triacs 95A to 95I for the track sections 10B. The outputs 92A to 92I also, of course, supply the gates 85A to 85I to override random run signals. One further alternating current drive line 97 is shown branched to the NOR gates 84 to supply drive current for the above mentioned first-length movement up to the start of the race. Clearly, AND gates 98, 99, 100 in the lines 86, 91 and 97 will suffice, enabled by timer lines 61G, 61H and 61E, respectively. For preference, the AND gate 99 remains enabled during the programme run also, as indicated by OR-gate 101.

As thus far described, the apparatus performs track drive on both a random and programmed run basis as desired, and it will be clear to those skilled in the art that both random run and programmed runs could be controlled in other manners, though we do believe that the presently described arrangements offer their own particular advantages. Also, of course, mention has been made of odds or paying out codes and the doubling thereof on an unpredictable basis that will, nonetheless, follow a desired long-term percentage that is adjustable. That function, too, could be performed otherwise, but again there is believed to be advantage in that specifically described.

In order to take practical advantage of what has been described thus far, we also provide a communication system from the control unit to player position units or stations 110 whereat any betting or "playing" takes place by users of the equipment.

To this end, the control equipment is also shown to be provided with a data transmitter 115 and communication lines 116 to the player stations 110. The units 110 are believed to be of considerable interest and inventive value, but, in the interests of good order, the data transmitter is first described, though the value of some features thereof will be apparent only when we come to describe a player station unit 110.

Figure 5:
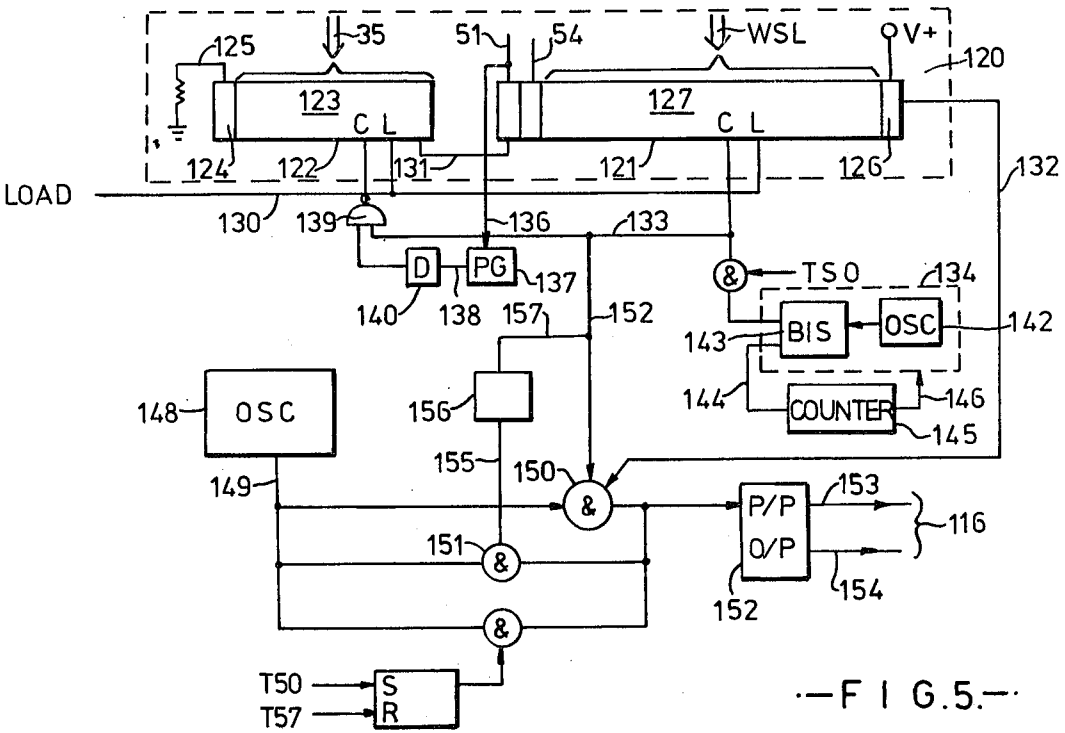
FIG. 5 shows the data transmitter.

In FIG. 5, data transmitter 110 is shown to comprise a shift register 120 to serve in converting data from parallel to serial form for transmission purposes over a two-wire-only link 116.

The shift register 120 is shown in two parts 121 and 122, of which part 122 has sufficient stages to accommodate a binary number specifying the payout code plus two further stages, one at each end. The payout code is actually loaded from lines 35 in reverse order into the stages 123 of register part 122 next to its most significant stage 124, which will always be constrained by earth connection 125 to be binary "0" to indicate message end and enable doubling. The other part 121 of the shift register always has its least significant stage 126 at binary "1" to indicate message start, and the stages 127 of next significance will receive the win selection lines WSL, leaving the two stages 128 and 129 for single and double payout lines 54 and 51. Loading of the shift register 120 will take place on staticisation of the form logic of FIG. 2 by a pulse signal on line 130. A link 131 is shown between the register parts 121 and 122 for clocking out a message on output 132 when clock line 133 is energized, say at the time slot TS0 corresponding to the win bell. A frequency of 100 to 200 Hz on line 123 from source 134 via AND gate 135 is satisfactory for shift register operation, especially for the preferred transmission mode of long and short bursts of 5–10 K Hz signals for binary "1" and binary "0", respectively.

A preliminary one-stage shift of the payout code in register part 122 is provided to accomplish odds doubling when line 51 is at binary "1", as indicated by branch line 136 therefrom to a one-pulse generator 137. Output 138 of generator 137 is shown applied to OR-gate 139 together with shift clock line 133 but via a delay 140 to ensure that loaded data has settled in the shift register 120.

For a particular shift clock oscillator frequency, say of 200 Hz, it is preferred effectively to halve that frequency and to utilise a full half cycle thereof for the long binary "1" representative pulse. Thus, source 134 is shown as comprising an oscillator 142 and a bistable 143 whose other output 144 is used to operate a message length counter 145 which, over line 146, will disable the oscillator 142 or hold the bistable 143 reset once the shift register 120 has been fully clocked and counter 145 reaches capacity or a predetermined number.

A source of high frequency signals for transmission is shown at 148 with its output 149 connected to AND gates 150 and 151. Gate 150 is jointly enabled by branch 152 from clock shift line 133 and by output 132 from the shift register 120, so that a burst of output from oscillator 148 will be passed to a push-pull output stage 152 driving lines 153 and 154 of communication link 116, but only for binary "1" on line 132. For binary "0" on line 132, the gate 150 will not be enabled. A shorter binary "0" burst, usually 1/5th that for binary "1", is obtained via AND gate 151 enabled by output 155 of a pulse generator or shortener 156 branched at 157 from shift clock branch 152. Thus, either a long or a short burst of oscillator output 149 must be transmitted for each binary digit from the shift register and those bursts will be separated by half cycles of the oscillator 142. Obviously, any desired synchronization or settling-time delays can be built into the circuitry just described.

Other advantages arise from this mode of data transmission, in that it is very tolerant of noise and, by trailing edges of tone bursts, actually supplies a clocking signal to the player station units.

One other feed for the output 149 of the oscillator 148 to the output stage 152 is shown via AND gate 158 controlled by a signal on line 159 from a bistable 160 that is set at the win bell time TS0 and reset at the start of program run TS7, to indicate when the player station unit may be used as will be described so that no bets can be placed after program run commences.

Figure 6:
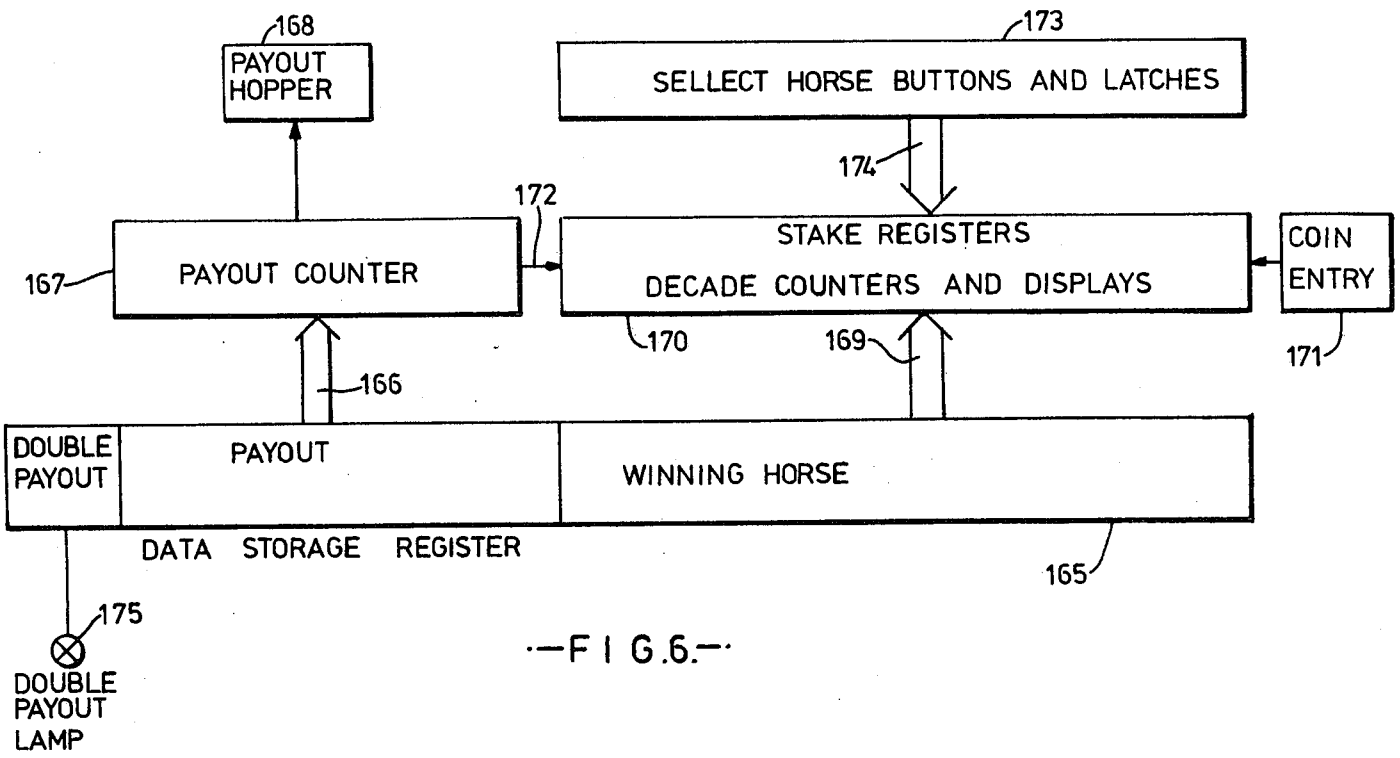
FIG. 6 shows a typical player station unit.

We now turn to the player station units, and to FIG. 6 initially. In FIG. 6, a typical unit is shown to comprise a data storage register 165 for payout control purposes via lines 166 to payout counter 167 in turn controlling a payout hopper 168, and, for display purposes, via lines 169 to block 170 representing registers and counters for stakes placed via coin entry device 171 and displays for those registers and counters. Line 172 from the payout counter indicates desired decrementing of the counters and displays during payout. Block 173 represents touch-switches on push-buttons and latches therefor by means of which a player may select a particular horse or horses on which to place his bets, and the counters, registers and displays of block 170 are correspondingly controlled over lines 174. A double payout lamp is also indicated at 175.

Figure 7:
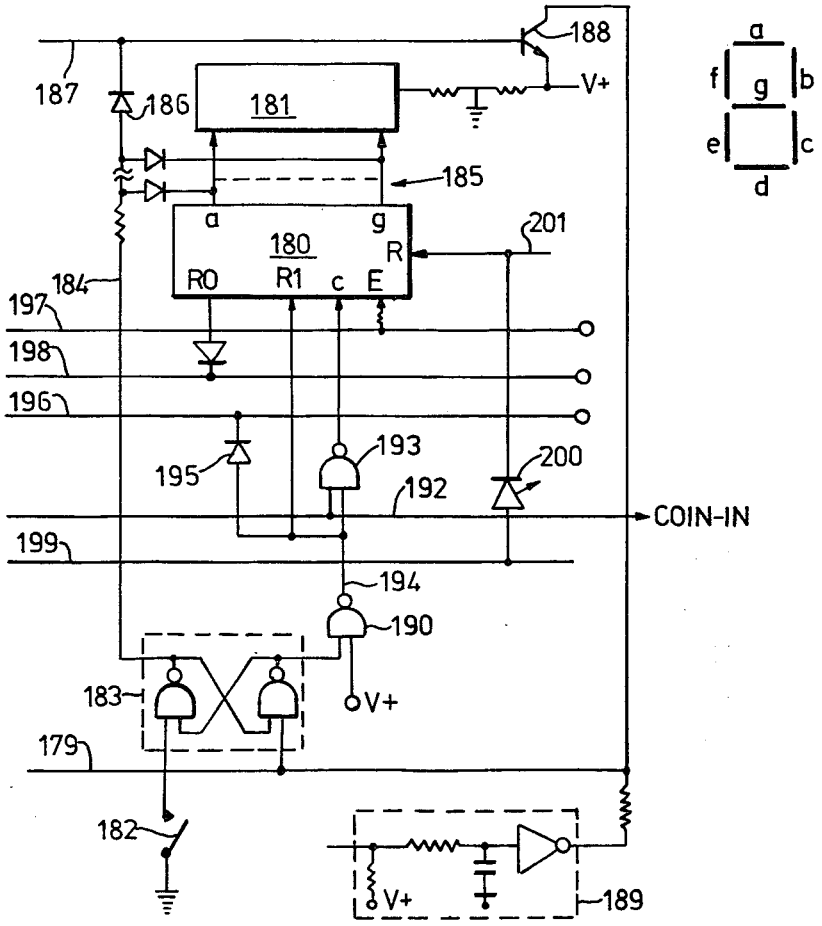
FIG. 7 shows the details of a stake counter.

FIG. 7 shows greater detail of a stake counter 180, of which there will, of course, be as many as there are horses. The counter 180 drives a conventional common cathode 7-segment display 181 of its contents, generally to a maximum to 8 unit stakes, but any digit display could be used. At the time that the horses begin their reverse run latch reset bus 179 will go high and all of the displays 181 are blank.

The circuitry of FIG. 7 actually uses a particular type of divide-by-ten UP counter available under type number CD 4033 and having a count input 'C' responsive to leading or trailing edges of pulses according to whether terminal 'E' is low or high, respectively. Also, terminal 'R0' will be low whenever the counter contents are zero and terminal 'R1' enables the display decode logic of the counter if high, and blanks the display if low and counter contents are zero.

On selection by temporary closure of switch 182, latch circuit 183 will be set causing R1 terminal to go high via line 194 and the display 181 to show zero. Bus 196 common to all of the horse circuits represents selection and also goes high and is used to enable coin mechanisms. Line 184 is connected via diode 186 to a bus 187 common to select lines of other horse counter/displays. Bus 187 controls conduction of a transistor 188 acting as a thresholder to go conductive if two or more horse selection switches, such as 182, are simultaneously operated. If that occurs, multiple stake counter operation is prevented by operation of a reset latch 189 that resets all select latches 183 and also clears displays 181.

An inverter 190 on the other output 191 of select latch 183 ensures that a high pulse signal from the coin entry device 171 on bus 192 will via gate 193, causes incrementing of the counter 180 on return of the gate output to its high state, but only if the corresponding select switch 182 has operated its latch 183. At this time, of course output R0 of the counter 180 and thus bus 198 go high.

Obviously, another horse can then be selected by its switch 182, when the first selected latch 183 will reset and the next selected one will set, but the first counter will retain its contents due to the R1 terminal blanking the display only if the counter is zero.

One other bus common to the horse selection circuitries is shown at 197 to serve in decrementing the counter on pay-out. A final bus 199 is for operating a win lamp 200 if the counter 180 corresponds to a winning horse as selected on line 201. Line 201 for unselected horses cause resetting of corresponding counters 180.

When the player terminal units receive a no more bets signal, the latch reset bus 179 is held low so that further selection and coin insertion is inhibited.

A truth table for the buses of FIG. 7 relative to sequential operation of a player unit is shown in Table B, were 'I' and 'O' represent high and low states, and ⊔ represents a momentary pulse, the multiple showing of the latter on payout being explained later.

TABLE B

| BUS | BET | SELECT ONE | SELECT MULTIPLE | COIN IN | NO BETS | PAY | |
|---|---|---|---|---|---|---|---|
| 187 | 0 | 0 | 1 | 0 | 0 | 0 | THRESHOLD |
| 197 | 0 | 0 | 0 | 0 | 0 | ↑ . . . ↑ | DECREMENT |
| 198 | 0 | 0, 1 | 1 | 1 | 1 | 0 | COUNTER '0' |
| 196 | 0 | 1 | 0 | 1 | 0 | 0 | SELECTED |
| 192 | 0 | 0 | 0 | ↑ | 0 | 0 | COIN IN |
| 199 | 0 | 0 | 0 | 0 | 0 | 1 | LAMP |
| 179 | 1 | 1 | 0 | 1 | 0 | 0 | RESET |

The limit on stake units per horse need not be the same as the capacity of counters 180. A preset for that limit is represented by diodes connecting line 184 selectively with lines 185 from counter 180 to display 181 to cause operation of the threshold circuit 188 once the limit is exceeded. For a conventional decimal counter 180 with seven display drive lines 185 a-g, diodes to the first two (a, b) and last two (f, g) lines will produce a limit of eight. This may be done by replaceable diode cards to adjust such limits, as for odds and payout code adjustment previously described for the program unit 28.

Figure 8:
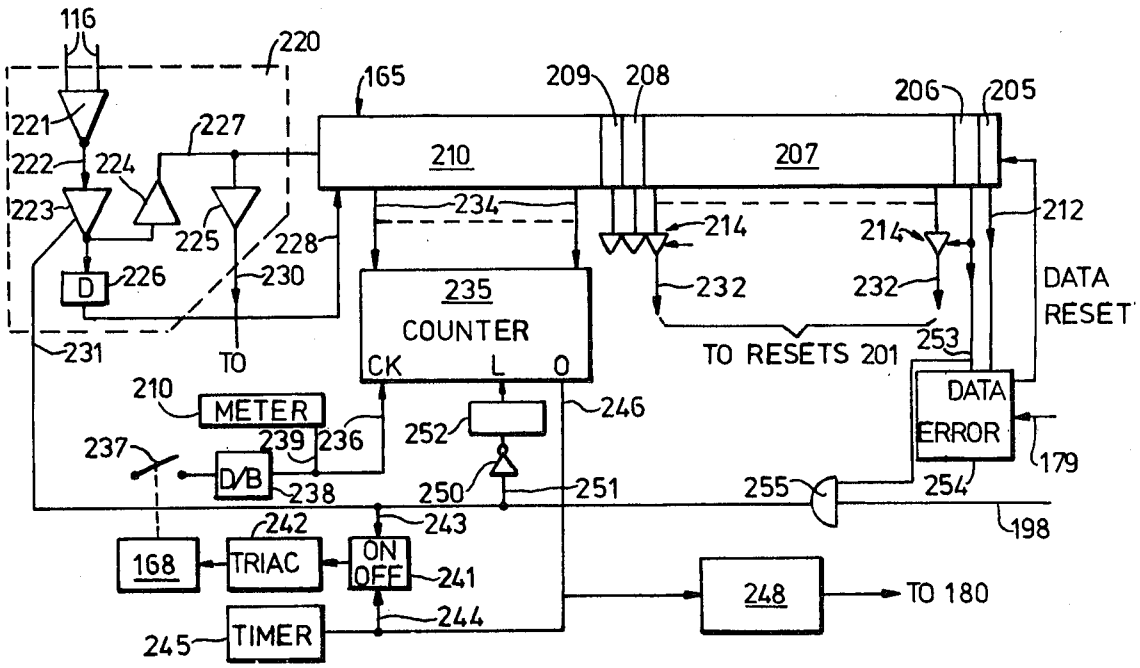
FIG. 8 shows the data reception register.

FIG. 8 shows the data reception register 165 in greater detail as having an endmost error detection stage 205 next to a "data-correct" detection stage 206 followed by horse selection stages 207, single/double payout stages 208 and 209, and payout code stages 210. No final stage is shown for the message-end digit, but one could obviously be provided so that correct reception of data is indicated only if that stage contains binary "0" and stage 206 has binary "1" as mentioned above. If stage 205 has a binary "1", an error must have occurred and the whole unit will be disable by line 212. Outputs from stages 207 to 209 will be inhibited via amplifiers 214 until stage 206 has a binary "1" therein.

Data register 165 is actually a shift register that receives data from lines 116 via detection circuitry 220. The latter comprises detection amplifier 221 with output 222 connected to three integrators 223, 224 and 225. The first, 223, has a short time-constant to ensure being driven by less than a binary "0" pulse burst and serves to generate clock signals after a suitable delay at 226. The second, 224, serves to detect binary "1" pulse bursts and so has a time-constant sufficient to exclude binary "0". Output 227 of integrator 223 supplies data inputs to the shift register 165, and clock signals on line 228 from delay 226 should thus exceed the time constant for integrator 224. The third integrator 225 is operated only by pulse bursts much longer than for a binary "1" so that it, in effect, detects continuous received tone and its output 230 serves to control betting by disabling the coin entry device 171. In addition, output 230 preferably serves to disable selection counters and displays by its control of the selected bus and thus permitted state of the select latch output in the circuitry of FIG. 7.

A clock inhibit signal is also shown applied over line 231, which is actually an extension of the bet-present bus of FIG. 7 and serves to prevent further data reception by that player station unit until payout is complete. However, of course, only the selection counter and register corresponding to a winning horse is permitted to be held after data reception, according to the output 232 of the amplifiers corresponding to the horse winning stages 207 of the shift register 165. All other selection counters and displays will be cleared either on message receipt or at the latest on completion of payout.

Upon receipt of a complete message, the register stages 210 will, of course, contain the payout code, i.e. the number of coins or tokens to be dispensed per unit stake on the winning horse. Their outputs 234 are shown applied to a counter 235.

The counter 235 is decremented by pulses on line 236 from a dispensed coin or token operated switch 237 of the pay-out hopper 168 via de-bounce circuit 238. The line 236 is also branched at 239 to drive a cumulative pay-out meter 240. A hopper driver 241 operating via triac circuit 242 is shown with on and off controls 243 and 244. A timer 245 serves to place a maximum limit or pay-out in the event of errors causing pay-out beyond the maximum permitted. The hopper driver will also be stopped by an all-zero signal on line 246 from the counter 235. The hopper driver 241 will be enabled on line 243 only if the pay-out station has bets made on the winning horse as indicated by its connection to the bet-present bus 198 which will fail to be reset only if one of the outputs 232 prevents resetting one of the counters 180 that is non-zero.

The zero-output 246 of the counter 235 is also shown applied to a pulse multiplier circuit 248 that will usually include a fast clock, say of 5–10 KHz, to provide bursts of pulses less than the capacities of counters 180 by one. That effectively decrements the relevant counter 180 by counting up one less than its capacity which also ensures that such counter 180 will pass through its zero condition on each "decrement" but not terminate there except for the last decrement from one-to-zero. Thus, zero output from such counters 180, then represented by no bet present, see inverter 250 in branch 251 from line 198, will be pulsed to reload the counter 235 due to pulse detector 252 on each decrement but the last, via AND gate 255 also receiving output 253 from the data-in detection stage 206 of the shift register 165.

We have mentioned before the possibility of using different designs of specific circuitry for implementing various functions required herein, and the fact that particular advantage is believed to be present in specific proposals hereof, such as applied to the randomizing, data transmissions, adjustable payout code doubling, and operation of player station units. Such specific proposals may, of course, have wider application where their functions, or functions analogous or related thereto, can be used.

We claim:

1. Amusement apparatus including means for controlling the movement of a plurality of objects simultaneously over a course having a first part and a last part in each of successive games, the apparatus including means for selecting which of the objects shall win a particular game by traversing the course first and furthest; other means for moving the objects irregularly over at least a first part of the course; and means operative subsequently, but in response to the means for selecting, for moving at least the selected object in ensuring it is the only one movable over a last part of the course and preventing the remaining said objects from entering said last part of the course.

2. Apparatus according to claim 1, comprising an overall game timer and sequencer comprising a capacitor charged conjointly by noisy oscillator means and successively enabled ones of resistive means corresponding to desired time slots in a sequence including one time slot for each of operating indication means for the winning object, for a pause, for applicaltion of return drive to bring all of the objects back to the start, for operating indication means that another game is about to start, for moving all of the objects by a short predetermined distance along the course, for a second pause, for the irregular movement of the objects, and for causing the selected object to win, at least some of said resistive feeds being variable to adjust said time slots.

3. Apparatus according to claim 1, comprising means for substantially randomly energizing drive means of said objects over at least said first part of the course.

4. Apparatus according to claim 3, wherein the means for energising is controlled by a quasi-random generator of twisted-tail shift register configuration.

5. Apparatus according to claim 1, comprising means for substantially unpredictably controlling the means for selecting which of the objects shall win.

6. Apparatus according to claim 5, wherein the unpredictable control means includes an erratic oscillator susceptible to noise and operative to staticise means for cyclically energising a plurality of win selection lines each for a different said object.

7. Apparatus according to claim 1, wherein the means for selecting includes means for applying predetermined probabilities to the objects as to their being selected to win.

8. Apparatus according to claim 7, wherein the probability applying means includes means for storing a plurality of binary numbers applicable to different ones of said objects, to vary the proportions of an overall cycle time that are available for the objects each to be selected to win.

9. Apparatus according to claim 8, comprising a counter, means for successively loading the counter with said binary numbers and means for decrementing the counter each time to zero to determine dwell times during which corresponding said objects are available for selection to win.

10. Apparatus according to claim 8, wherein the means for storing has additional capacity at each said binary number for storing a further binary number designating a payout amount if the corresponding object is selected to win.

11. Apparatus according to claim 10, comprising means for reading out and selectively increasing that further number on an unpredictable basis.

12. Apparatus according to claim 11, comprising markspace setting means that is adjustable to vary the frequency of incidence of said increasing.

13. Apparatus according to claim 1, further comprising data transmission means and at least one player station connected to such data transmission means and having means for displaying information concerning the objects and the winning object, and means for entry of choice by a player of which of the objects he thinks may win.

14. Apparatus according to claim 13, wherein each player station includes means for accepting choice tokens and means responsive to data from said data transmission means for paying out tokens in the event of a chosen object winning.

15. Apparatus according to claim 14, wherein each player station includes means for preventing token entry for each particular game after drive is applied to ensure that the selected object is first to an end part of the course.

16. Apparatus according to claim 14, wherein each player station includes for each object, a stake counter and associated display operative for each corresponding said choice and means for disabling choice token entry and counter operation if more than one object is chosen.

17. Apparatus according to claim 16, wherein each player station includes means for resetting stake counters of each object that did not win, means for paying out tokens and decrementing the winning object's stake counter to zero by successive counts, for each paid out token, of one less than the counter capacity.

18. Apparatus according to claim 16, wherein at least some of said resistive means are variable and the timer is operative to set a sequence of time-slots for each of successive games, the sequence including time slots for operating indication means for the winning object, for a pause, for application of return drive to bring all of the objects back to the start, for operating indication means that another game is about to start, for moving all of the objects by a short predetermined distance along the course, for a second pause, for the irregular movement of the objects, and for causing the selected object to win.

19. Apparatus according to claim 13, wherein the data transmitter comprises a shift register with stages corresponding to winner selection and payout amount, and means for constraining same to a check digit value.

20. Apparatus according to claim 19, wherein transmission for each digit value is controlled by a first frequency signal from a source therefor and means for transmitting relatively long and short bursts of a second higher frequency signal from a source therefor during predetermined parts of each cycle of the first frequency signal.

21. Apparatus according to claim 20, wherein each player station comprises digit detection means having three integrators of different time constants, one shorter than said short digit burst to generate clock signals, one longer than said short digit burst to discriminate digit values, and one longer than said long digit burst as a disable at least for players choice of winning objects.

22. Apparatus according to claim 1, comprising an overall timer comprising a capacitor charged conjointly by noisy oscillator means and successively enabled ones of resistive means corresponding to said time slots.

23. Amusement apparatus including means for controlling the movement of a plurality of objects simultaneously over a course having a first part and a last part in each of successive games, means for establishing probabilities for each object to complete the course first in any game, the means for controlling being responsive to the means for establishing and to means for ensuring that the first object to complete the course and thus win is not predictable, and means for generating data representative of the winning object, and payout in accordance with its odds; a plurality of player stations each including means for displaying said odds for the objects and for the first object to complete the course in any game, means for entering a choice by a player of which of the objects he thinks may win, means for accepting choice tokens representing a bet stake on that choice, and means for paying out tokens in accordance with said odds in the event of the chosen object winning, and data transmission means for sending data from the means for generating to means at each player station for receiving said data and controlling operation of the means for paying out.

* * * * *